US006167922B1

(12) United States Patent
Seitz et al.

(10) Patent No.: US 6,167,922 B1
(45) Date of Patent: Jan. 2, 2001

(54) WATER DEFLECTION SYSTEM FOR USE IN FUEL DISPENSER CABINETS

(75) Inventors: Gary L. Seitz, Decatur; Adam T. Graham, Fort Wayne, both of IN (US)

(73) Assignee: Tokheim Corporation, Fort Wayne, IN (US)

( * ) Notice: Under 35 U.S.C. 154(b), the term of this patent shall be extended for 0 days.

(21) Appl. No.: 09/305,627

(22) Filed: May 5, 1999

(51) Int. Cl.[7] ..... B65B 1/04; B65B 3/04; B67C 3/02

(52) U.S. Cl. ..... 141/97; 141/86; 141/98; 222/108; 222/111; 312/229

(58) Field of Search ..... 141/86, 97, 98; 222/27, 72, 75, 108, 111; D15/9.1–9.3; D25/33; 312/229

(56) References Cited

U.S. PATENT DOCUMENTS

| | | | |
|---|---|---|---|
| Re. 21,741 | | 3/1941 | Samiran . |
| 2,016,867 | | 10/1935 | Marden . |
| 2,204,998 | | 6/1940 | Ryan et al. . |
| 2,329,728 | | 9/1943 | Samiran . |
| 2,411,749 | | 11/1946 | Oberly et al. . |
| 2,680,538 | | 6/1954 | Fishburn . |
| 4,576,312 | * | 3/1986 | Swick, Jr. ..... 222/27 |
| 4,722,800 | | 2/1988 | Aymong . |
| 5,088,530 | | 2/1992 | Harp . |
| 5,132,011 | | 7/1992 | Ferris . |
| 5,167,470 | | 12/1992 | Bertolozzi et al. . |
| 5,203,386 | | 4/1993 | Harp . |
| 5,246,044 | | 9/1993 | Robertson et al. . |
| 5,257,652 | | 11/1993 | Lawrence . |
| 5,301,722 | | 4/1994 | Todd et al. . |
| 5,538,052 | | 7/1996 | Harp . |

* cited by examiner

*Primary Examiner*—Timothy L. Maust
(74) *Attorney, Agent, or Firm*—Randall J. Knuth

(57) ABSTRACT

A cover assembly for use in a fuel dispensing cabinet includes an upper shroud member and a lower shroud member that are arranged at a side area of the cabinet chassis proximate the sump facility. The shroud members are provided in a shingle-type configuration in which the upper shroud member at its lower edge portion overlaps with the lower shroud member at its upper edge portion. A pair of elongate column channel members are configured at respective corner posts of the chassis and each includes a vertical channel portion that receives the side edge portions of the upper and lower shroud members. A fluid diversion assembly is arranged within the chassis end area adjacent the electronics compartment at the upper section of the cabinet. This assembly includes a transverse wall structure having a shoulder portion providing an "S"-shaped cross-section, a splash shield disposed in seating engagement with such shoulder portion, and a seal plate provided in adjacent surface-abutting engagement with the transverse wall structure. These structures cooperatively define a transverse fluid passageway that allows fluid striking the splash shield to flow into the passageway, which is provided in fluid communication with the respective channel portions of a pair of elongate column channel members so as to enable such diverted fluid to be transported outside the cabinet.

26 Claims, 11 Drawing Sheets

WATER DEFLECTION SYSTEM FOR USE IN FUEL DISPENSER CABINETS

BACKGROUND OF THE INVENTION

1. Field of the Invention

The present invention relates to a water deflection system for preventing water from entering the hazardous waste collection area of a fuel dispenser cabinet, and, more particularly, to a multi-piece shroud assembly removably attached to the chassis cabinet and arranged to prevent water from entering the cabinet interior and also to redirect water present within the cabinet head area into a fluid channel that deposits the channeled water beyond the cabinet boundaries.

2. Description of the Related Art

Refueling service stations employ a cabinet assembly to house the various components used to dispense fuel such as the fuel pump, valve assembly, and metering equipment. The cabinet assembly typically includes a chassis or other such frame structure that is divided into an upper end and a lower end by an intervening barrier plate that extends through the interior of the chassis in the form of a vapor-impenetrable shelf. The upper end of the chassis defines a compartment space that would contain, for example, an array of electronics components used to facilitate the initiation and processing of customer requests for refueling transactions. An input device in the form of a customer-interactive keypad could be configured in this compartment space.

The lower end of the chassis contains various conventional support structures for integrally housing the fuel dispensing apparatus. The fuel lines connected to the fuel dispensing apparatus typically enter the chassis at its upper end or head area and traverse the end column areas of the chassis before entering the lower end of the chassis for attachment to the proper devices. The vapor lines are configured within the chassis in a similar manner. The fuel dispensing apparatus is conventionally coupled to a fuel conveying hose attached to a maneuverable manually-activatable nozzle assembly that is positioned within a holding receptacle integrally arranged with the fuel dispensing cabinet.

Environmental regulations and safety provisions require the placement of a sump facility immediately beneath the cabinet to facilitate the collection of any fuel that has escaped from the fuel dispensing system in the form of vapor condensate or due to a break or leak in the fuel line, for example. The contents of the sump facility are subsequently removed for appropriate disposal, reconditioning, or other suitable processing. One key aspect of this disposal operation involves the lack of any type of content discrimination in regards to the types of fluid present within the sump facility. For purposes of handling and treatment, the entire contents of the sump facility are considered hazardous waste material and therefore subject to the applicable hazardous waste disposal regimen irrespective of the amount of non-volatile fluid such as water that enters the sump facility and becomes commingled with any liquid fuel. The costs associated with such sump disposal operation depend directly upon the volume of fluid (i.e., fuel and water) retrieved from the sump facility. Accordingly, it is imperative to develop construction safeguards and other such strategies that aim to eliminate the migration of water into the sump facility lying underneath the fuel dispensing cabinet.

The outermost shell or "skin" of a typical fuel dispensing cabinet includes a metal enclosure having various sections in the form of doors or discrete panels that are attached to the chassis to generally define a barrier separating the interior space of the chassis from its external surroundings. This barrier or inner skin would lie behind the nozzle boot, for example. However, enclosures of this type clearly do not provide any significant measure of waterproofing and in fact provide an inferior level of water repellency due to the various seams that run along the edges of the enclosure panels. These enclosure arrangements could be considered suitable for intermittent or light downfalls of rain but would offer barely any protection under the sustained exposure to even a moderate rainfall or a simple maintenance washing of the cabinet. Since the metal enclosure arrangement exists as the innermost "skin" or barrier layer surrounding the interior space of the chassis, any water penetrating past such barrier may enter the sump facility directly or simply migrate over time under the influence of gravity until it reaches the bottom of the chassis where the sump area exists.

Of additional concern is the passage of water into the head area of the chassis where any buildup of fluid could easily compromise the integrity of the electronics enclosure area and impair the functionality of the various devices. Even if the electronics devices are adequately protected from fluid penetration, the presence of such fluid still remains a problem because of the very real possibility that the foreign fluid will eventually find a path to migrate along with the assistance of gravity until it reaches the underlying sump facility.

One approach to enhancing the level of hydraulic protection afforded by current metal enclosure arrangements involves the use of a system of gaskets and other such sealing elements that are adapted in form and shape to the geometries of the individual devices needing protection and to the particular seam configurations created by the set of metal enclosure pieces installed within the cabinet. This type of customized solution has several drawbacks including the complexity of design due to the irregular sealing geometries needed to accommodate the various device structures and seam contours, the high parts count arising from the array of gasket elements that are employed, and the lack of ready serviceability due to the intricate placement of the gaskets. The sensitivity of this gasketing strategy to the particular configuration of devices, the shape of the metal enclosure arrangement, and the chassis frame characteristics effectively eliminates this approach from any kind of universal application to other cabinet systems.

SUMMARY OF THE INVENTION

According to the present invention there is provided a water deflection system for use in preventing water from entering the fuel dispensing cabinet area and in diverting water present within the cabinet head area into a fluid passageway that transports the rerouted water to a point beyond the cabinet boundaries away from the sump facility. The water deflection system includes a pair of cover assemblies each integrally arranged with the cabinet chassis at a respective one of the chassis side areas that correspond to the working sides of the cabinet. Preferably, the cover assemblies are placed within the lower end of the chassis and extend upwardly from the chassis base where the sump facility is located. Each cover assembly is removably attached to the chassis frame and includes an upper shroud member and a lower shroud member each extending between the chassis end areas, wherein the lower shroud member is provided in subjacent relationship relative to the upper shroud member. The upper shroud member and lower shroud member are further arranged in a shingle-type configuration in which the upper shroud member at its lower edge portion overlaps with the lower shroud member at its upper edge portion.

The water deflection system further comprises an assembly of elongate column channel members each removably attached to a respective column corner post of the chassis and respectively including a fluid channel portion extending substantially in a vertical direction along the longitudinal dimension of the associated corner post. This assembly of column channel members is organized into two pairs of such channel members, wherein each such pair is associated with a respective cover assembly, i.e., an arrangement comprising an upper shroud member and a lower shroud member. The channel portion for each elongate column channel member is arranged to receive the associated upper shroud member at a respective shroud side edge portion thereof and to receive the associated lower shroud member at a respective shroud side edge portion thereof.

The water deflection system further comprises a pair of fluid diversion assemblies each integrally arranged with the chassis frame at a respective one of the chassis end areas. Preferably, the fluid diversion assemblies are placed within the upper end of the chassis adjacent the electronics enclosure compartment to make possible a fluid diversion activity that affects any water entering the chassis head space and which interacts with the fluid diversion assembly in the manner described hereinafter. Each fluid diversion assembly includes a transverse wall structure removably attached to the chassis and extending at least in part between the chassis side areas. The transverse wall structure includes a shoulder portion extending along its longitudinal dimension that results in a generally "S"-shaped cross-sectional profile for this part. A splash shield removably attached to the chassis is disposed at its lower edge portion in registered seating engagement with the shoulder portion of the transverse wall structure. A seal plate is disposed in adjacent surface-abutting engagement with the transverse wall structure so as to be arranged in spaced-apart relationship relative to the splash shield. The seal plate is preferably arranged in at least partial opposition to the splash shield. The arrangement defined by the structural combination of the splash shield (i.e., at its lower end), the seal plate (i.e., at its upper end), and the transverse wall structure (i.e., at its shoulder portion) cooperatively define a transverse fluid passageway extending along the longitudinal dimension of the transverse wall structure. This fluid passageway is sufficiently arranged to enable fluid communication with the channel portions of respective elongate column channel members associated with the cover assemblies at both the front side and back side of the chassis. Accordingly, any water that penetrates the chassis head area and has sufficient momentum to strike the inner-facing surface of the splash shield will thereafter be drawn downwardly along the splash shield surface under the influence of gravity, placed into the transverse fluid passageway, flow through the fluid passageway, and then be deposited into the vertical channel portion of an elongate column channel member, whereupon gravity will carry the fluid to the lower terminal end of the channel portion, which is provided with a descending lip structure to place the fluid outside the boundaries of the cabinet structure.

The invention, in one form thereof, is directed to a fluid deflection system for use in a fuel dispenser cabinet. The fuel dispenser cabinet includes a chassis having an interior space, a pair of opposing spaced-apart side areas, and a pair of opposing spaced-apart end areas extending between the pair of opposing side areas. The fluid deflection system comprises at least one cover means that is disposed at a respective one of the pair of chassis side areas for providing a fluid barrier at least in part between the interior space of the chassis and an exterior of the chassis. There is provided at least one channel means that is disposed at a respective corner post of the chassis for defining a channel formation extending in a substantially vertical direction. There is also provided at least one fluid diversion means that is disposed at a respective one of the pair of chassis end areas for providing a fluid passageway arranged to enable fluid communication with a respective one of the at least one channel means and for providing a contact structure extending from the fluid passageway which enables fluid in contact therewith to be drawn into the fluid passageway.

The at least one cover means further includes, in one form thereof, an upper shroud member removably attached to the chassis and extending between the pair of chassis end areas, wherein the upper shroud member has an upper edge portion and a lower edge portion. There is also provided a lower shroud member that is removably attached to the chassis and which extends between the pair of chassis end areas, wherein the lower shroud member has an upper edge portion and a lower edge portion. The lower shroud member is arranged in subjacent relationship relative to the upper shroud member such that the upper shroud member (at its lower edge portion) overlaps at least in part with the lower shroud member (at its upper edge portion).

The at least one channel means further includes, in one form thereof, a respective pair of elongate column channel members associated with each respective one of the upper shroud member/lower shroud member assembly. The elongate column channel member is removably attached to a respective column corner post of the chassis and includes a channel portion extending substantially in a vertical direction. The channel portion is arranged to receive the respective upper shroud member of the respective one cover means associated therewith at a respective shroud side edge portion thereof and to receive the respective lower shroud member of the respective one cover means associated therewith at a respective shroud side edge portion thereof.

The at least one fluid diversion means further includes a pair of fluid diversion assemblies each integrally arranged with a respective column end area of the chassis. Each fluid diversion assembly includes a transverse wall structure removably attached to the chassis, wherein the transverse wall structure extends at least in part between the pair of chassis side areas and includes a shoulder portion extending along the longitudinal dimension thereof; a splash shield removably attached to the chassis and having a lower edge portion, wherein the splash shield is disposed at its lower edge portion in registered seating engagement with the transverse wall structure at the shoulder portion thereof; and a seal plate disposed in adjacent surface-abutting engagement with the transverse wall structure, wherein the seal plate is arranged in spaced-apart relationship relative to the splash shield and is further arranged in at least partial opposition to the splash shield. The arrangement that comprises, in combination, the splash shield (at its lower end), the seal plate (at its upper end), and the transverse wall structure (at a part of its shoulder portion) cooperatively defines a transverse fluid passageway extending along the longitudinal dimension of the transverse wall structure. This transverse fluid passageway is sufficiently arranged to enable fluid communication with the respective channel portion of a respective elongate column channel member associated with at least a respective one of the at least one cover means.

The invention, in another aspect thereof, is directed to a fluid deflection system for use in a fuel dispenser cabinet. The cabinet includes a chassis having an interior space, a pair of opposing spaced-apart side areas, and a pair of opposing spaced-apart end areas extending between the pair of opposing side areas. The fluid deflection system comprises, in combination, a pair of cover assemblies each integrally arranged with the chassis at a respective one of the pair of chassis side areas, and a pair of fluid diversion assemblies each integrally arranged with the chassis at a respective one of the pair of chassis end areas.

Each respective one of the pair of cover assemblies respectively comprises: an upper shroud member removably attached to the chassis and extending between the pair of chassis end areas, wherein the upper shroud member has an upper edge portion and a lower edge portion; a lower shroud member removably attached to the chassis and extending between the pair of chassis end areas, wherein the lower shroud member has an upper edge portion and a lower edge portion; and a pair of elongate column channel members each removably attached to a respective column corner post of the chassis. The lower shroud member is arranged in subjacent relationship relative to the upper shroud member, wherein the upper shroud member (at its lower edge portion) overlaps at least in part with the lower shroud member (at its upper edge portion).

Each respective one of the pair of elongate column channel members respectively includes a channel portion extending substantially in a vertical direction, wherein the channel portion is arranged to receive the upper shroud member at a respective shroud side edge portion thereof and to receive the lower shroud member at a respective shroud side edge portion thereof.

Each respective one of the pair of fluid diversion assemblies respectively comprises: a transverse wall structure that is removably attached to the chassis, wherein the transverse wall structure extends at least in part between the pair of chassis side areas and includes a shoulder portion extending along the longitudinal dimension thereof; a splash shield that is removably attached to the chassis and having a lower edge portion, wherein the splash shield is disposed at its lower edge portion in registered seating engagement with the transverse wall structure at its shoulder portion; and a seal plate that is disposed in adjacent surface-abutting engagement with the transverse wall structure, wherein the seal plate is arranged in spaced-apart relationship relative to the splash shield and is further arranged in at least partial opposition to the splash shield. The arrangement that include, in combination, the splash shield (at its lower end), the seal plate (at its upper end), and the transverse wall structure (at a part of its shoulder portion) cooperatively define a transverse fluid passageway which extends along the longitudinal dimension of the transverse wall structure. The transverse fluid passageway is sufficiently arranged to enable fluid communication with the respective channel portion of a respective one of the respective pair of elongate column channel members from each respective one of the pair of cover assemblies.

One advantage of the present invention is that the water deflection system provides a waterproof structure in the form of a shroud arrangement that prevents external water from penetrating the cabinet area (i.e., sump facility) protected by this cover assembly and further provides a fluid diversion assembly that is able to capture water having already penetrated the cabinet head area and deposit it outside the cabinet boundaries using a minimal number of fluid passageways.

Another advantage of the present invention is that the water deflection system is characterized by ease of serviceability since the shroud members, elongate column channel members, and fluid diversion assembly components are removably attached to the chassis.

Another advantage of the invention is that the water deflection system represents a universal-type solution to the problem of providing a second "skin" to protect the cabinet chassis since the individual pieces for the shroud-type cover assembly and fluid diversion assembly do not generally need to account for the type of components being housed within the cabinet, which contrasts with the conventional approach employing a gasket-based strategy that customizes and tailors the sealing elements to the cabinet devices currently in use.

Another advantage of the invention is the reduced parts count for developing such an inner protective "skin" relative to conventional approaches.

A further advantage of the invention relates to the use of conventional plastics technology in the manufacturing and construction of the individual pieces of the water deflection system, and particularly the upper and lower shroud members, which provides a certain degree of design flexibility that permits the plastic structures to be reshaped according to the geometry and dimensions of the particular arrangement of devices housed within the cabinet without compromising the effectiveness of the cover assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
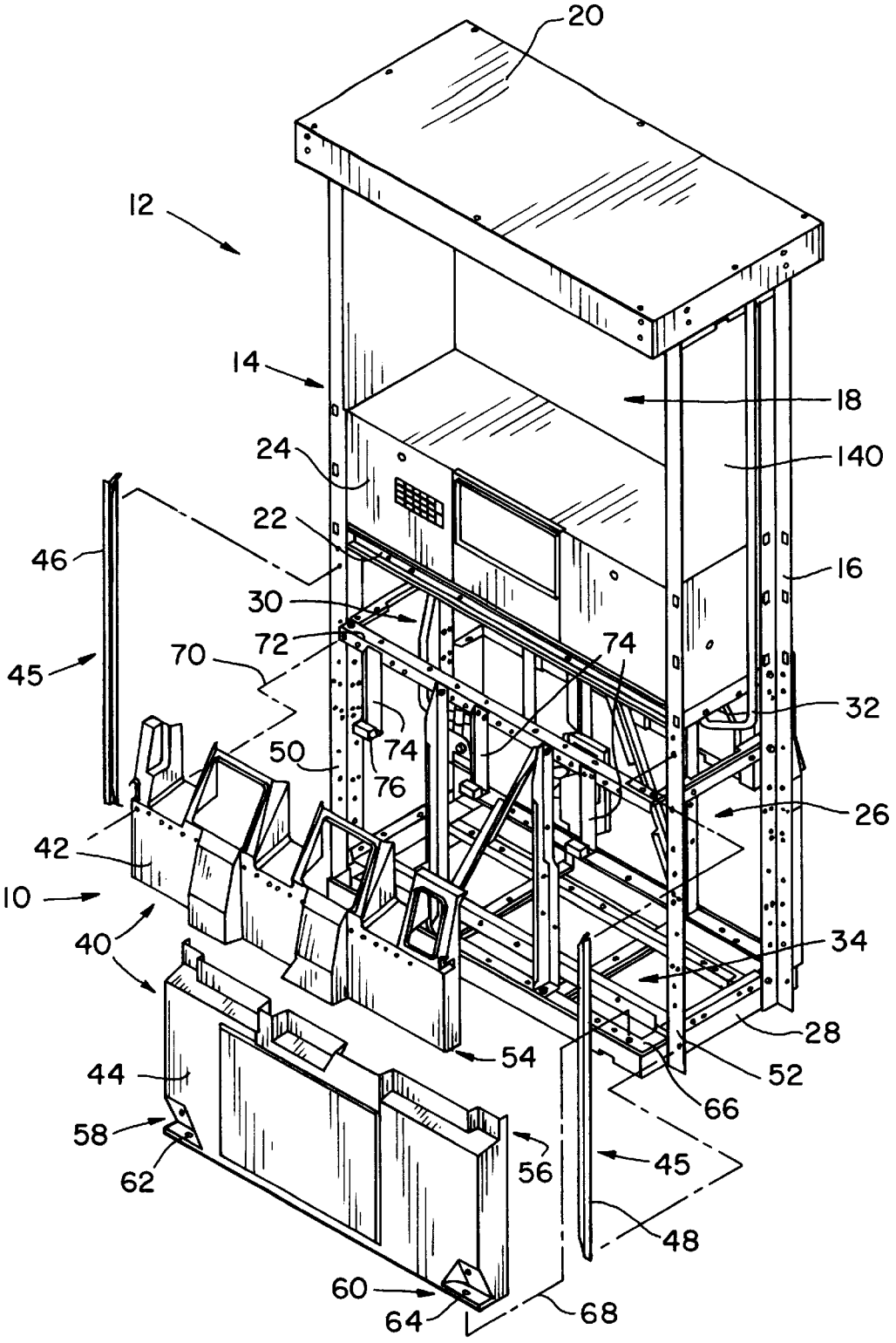
FIG. 1 is an exploded perspective view of the shroud assembly according to one embodiment of the present invention, which illustrates the registered relationship of the various shroud assembly parts to their corresponding areas of integral placement within a fuel dispensing cabinet.

Referring now to the drawings and particularly to FIG. 1, there is shown in exploded perspective view one illustrative assembly of parts belonging to a water deflection system 10 that is configured for integral installation within a fuel dispensing cabinet 12 according to the present invention. By way of background, cabinet 12 is provided in a conventional form including a chassis or frame structure generally illustrated at 14 including a set of four (4) column corner posts 16 arranged to define a pair of opposing, spaced-apart side areas and a pair of opposing, spaced-apart end areas that extend between the side areas. The chassis side areas correspond to the working sides of the cabinet where the fuel dispensing nozzle assembly is located (not shown) and where the customer can interface with electronics equipment to initiate a refueling transaction request. Chassis 14 has an upper section (generally illustrated at 18) defining a compartment space that is bounded at an upper end by a chassis head portion 20 and is bounded at a lower end by a barrier plate 22. Compartment space 18 is typically used as an electronics enclosure area to house electronics equipment 24 such as a combination input device and LCD apparatus that the customer interfaces with to initiate and monitor refueling transaction requests. Chassis 14 further has a lower section (generally illustrated at 26) lying beneath barrier plate 22 and which is defined at a lower end by chassis base 28. The illustrated chassis lower section 26 houses an array of components at device area 30, for example, such as the fuel pump, metering equipment, valve assembly, and other such fuel dispenser apparatus. This assembly would be connected to fuel lines such as representative fuel line 32 integrated within chassis 14 in a known manner. A conventional sump facility (generally illustrated at 34) lies immediately adjacent chassis base 28 and functions in a known manner to collect fuel that escapes from the fuel dispenser apparatus lying overhead (i.e., within device area 30) and which migrates downwardly into the illustrated sump facility 34, which is conventionally provided in the form of a pit, well, or basin-type structure. Chassis 14 is typically provided with a metal enclosure (not shown) in the form of doors or panels that are attached to chassis 14 to form the exterior shell of cabinet 12.

The conventional form for chassis 14 illustrated in FIG. 1 presents various problems in terms of the penetration of water into head portion 20 and sump facility 34. More particularly, water incident upon the lower chassis section 26 that penetrates past the outer metal door (e.g., via seams in the metal door arrangement) will migrate towards chassis base 28 and collect in sump facility 34, thereby becoming hazardous waste material subject to disposal. In accordance with one embodiment of the present invention disclosed herein, water deflection system 10 provides a cover assembly interposed between chassis 14 and the outer metal enclosure to thereby define a second barrier "skin" or layer that deflects away any water penetrating past the outer "skin" (i.e., metal enclosure). In particular, a pair of such cover assemblies are provided at the front and back sides of chassis 14 at the lower section 26 thereof.

Water may also enter cabinet 12 via the illustrated chassis head portion 20, eventually reaching sump facility 34 if such penetrating water is able to leak past chassis upper section 18 into chassis lower section 26. In accordance with another embodiment of the present invention disclosed herein, water deflection system 10 addresses this problem by providing a fluid collection and diversion assembly to collect fluid entering head portion 20 and then route it to a point lying outside cabinet 12 where it cannot access sump facility 34. In particular, a pair of such diversion assemblies are provided at the end column areas of chassis 14 at the upper section 18 thereof.

Figure 2:
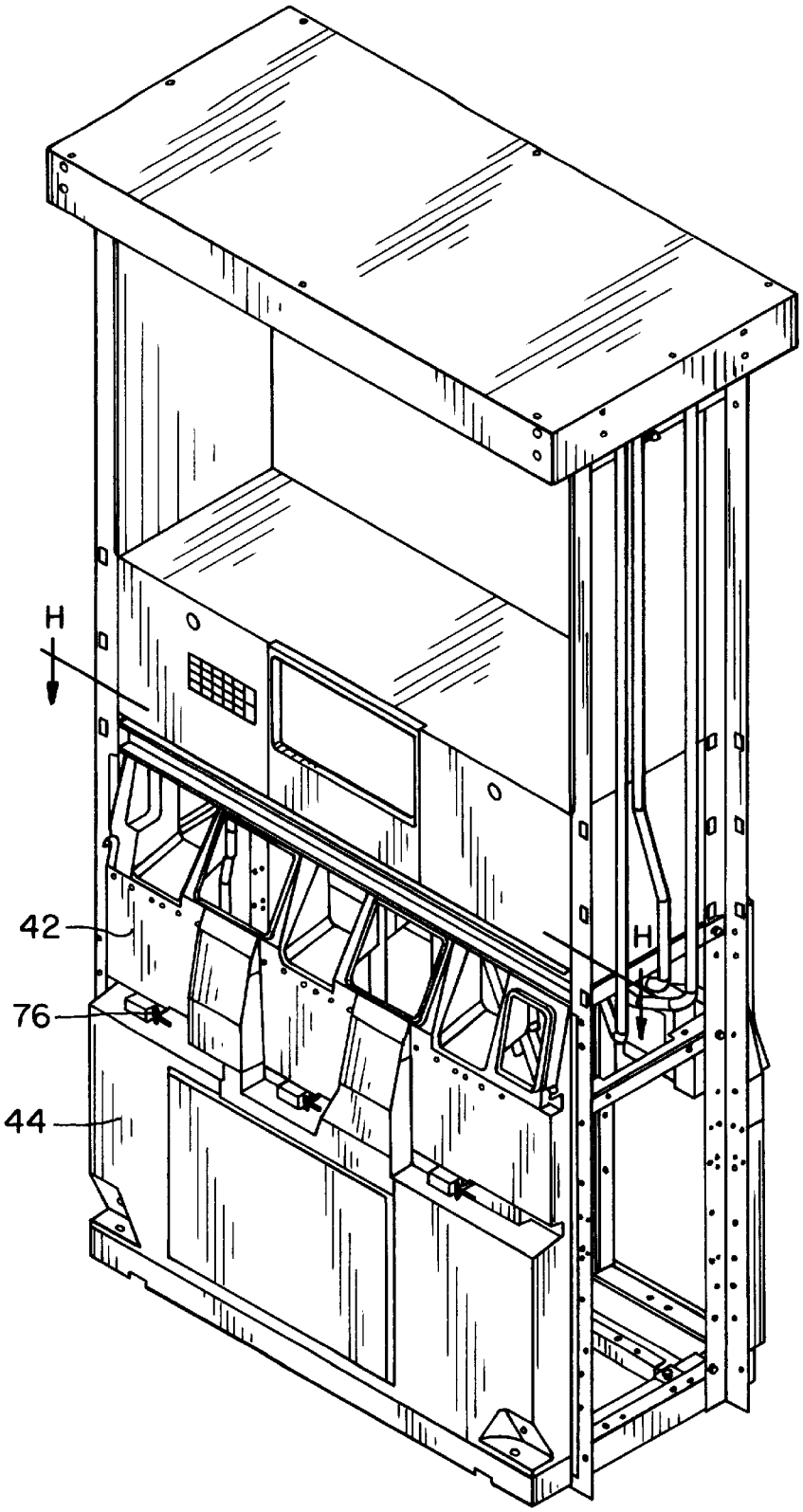
FIG. 2 is an elevational perspective view of the fuel dispensing cabinet shown in FIG. 1 as configured with the shroud assembly fully integrated with the cabinet chassis.
Figure 3:
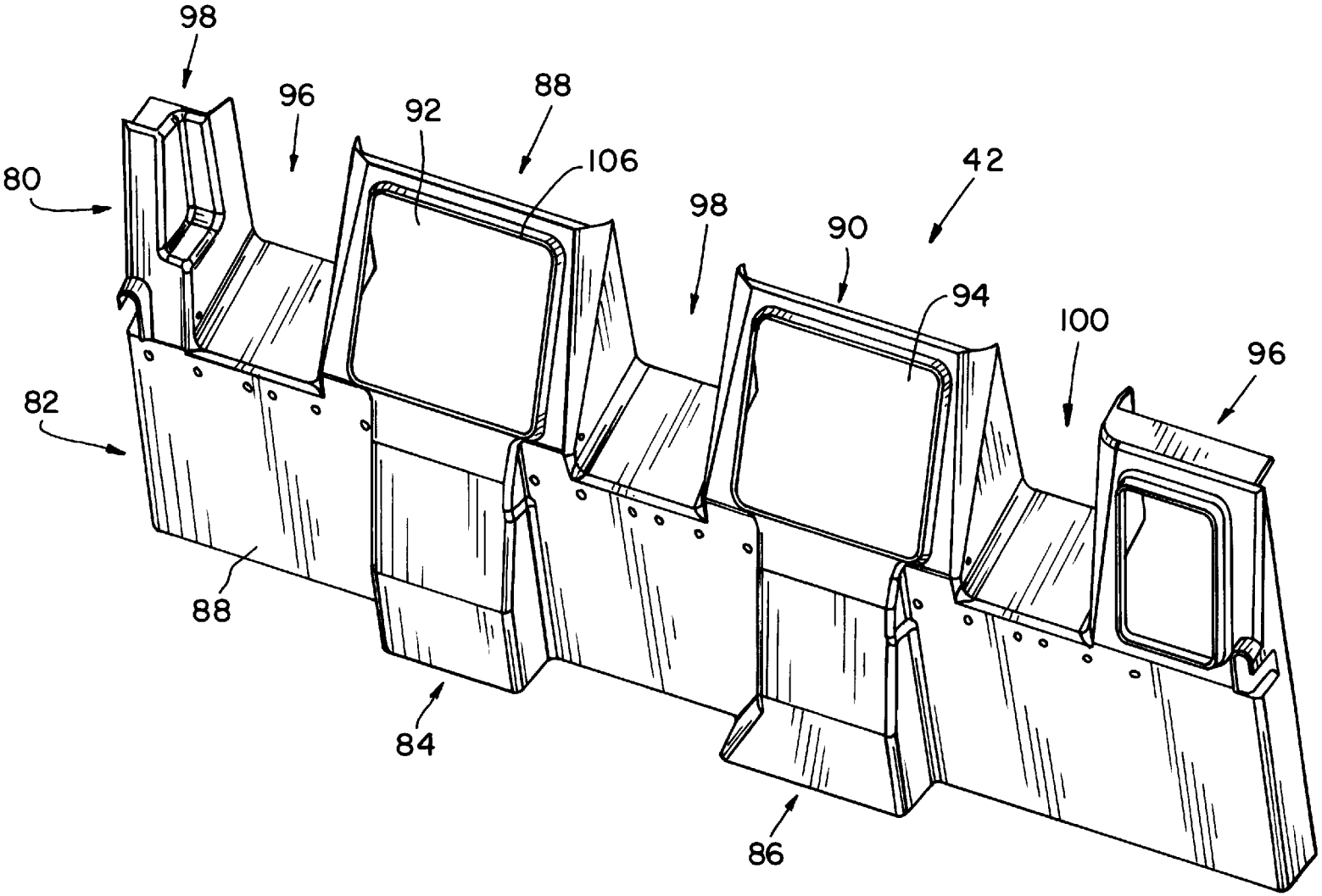
FIG. 3 is an elevational perspective view of the upper shroud member that forms one part of the shroud assembly illustrated in FIG. 1.
Figure 4A:
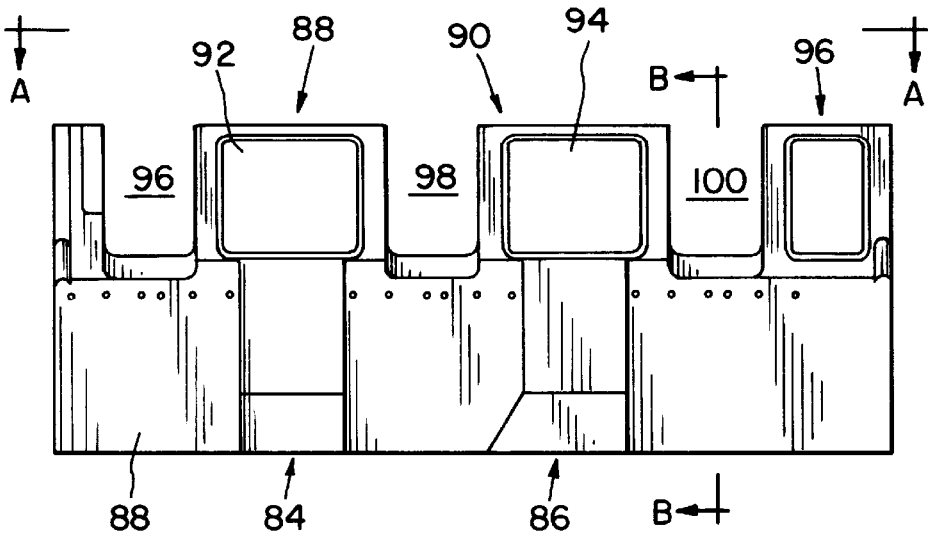
FIG. 4A is a front planar view of the upper shroud member shown in FIG. 3.
Figure 4B:
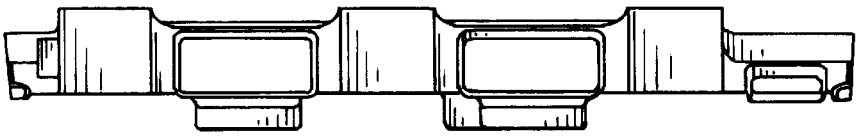
FIG. 4B is a top planar view of the upper shroud member shown in FIG. 3 taken along lines A—A of FIG. 4A.
Figure 4C:
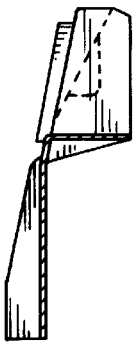
FIG. 4C is a lateral cross-sectional planar view of the upper shroud member shown in FIG. 3 taken along lines B—B of FIG. 4A.
Figure 5:
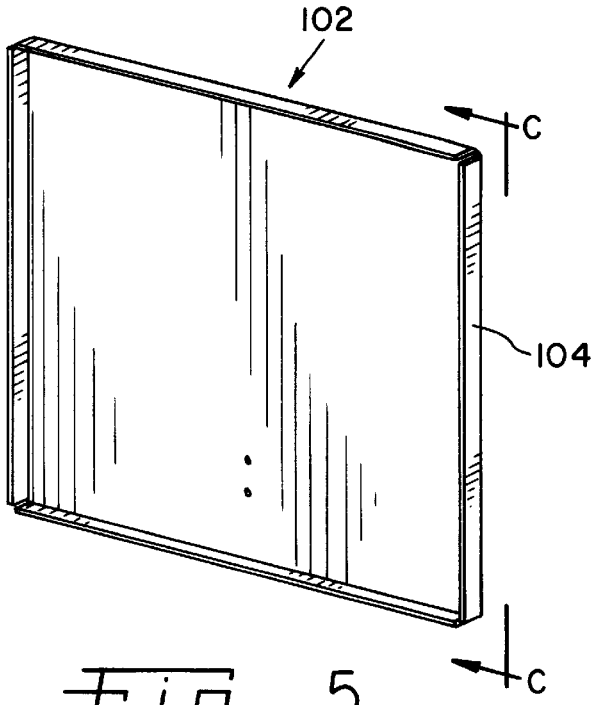
FIG. 5 is an elevational perspective view of a meter access cover for covering one of the access ports formed in the upper shroud member of FIG. 3.
Figure 6:
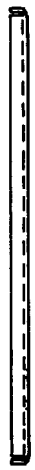
FIG. 6 is a lateral planar view of the meter access cover shown in FIG. 5 taken along lines C—C therein.
Figure 7A:
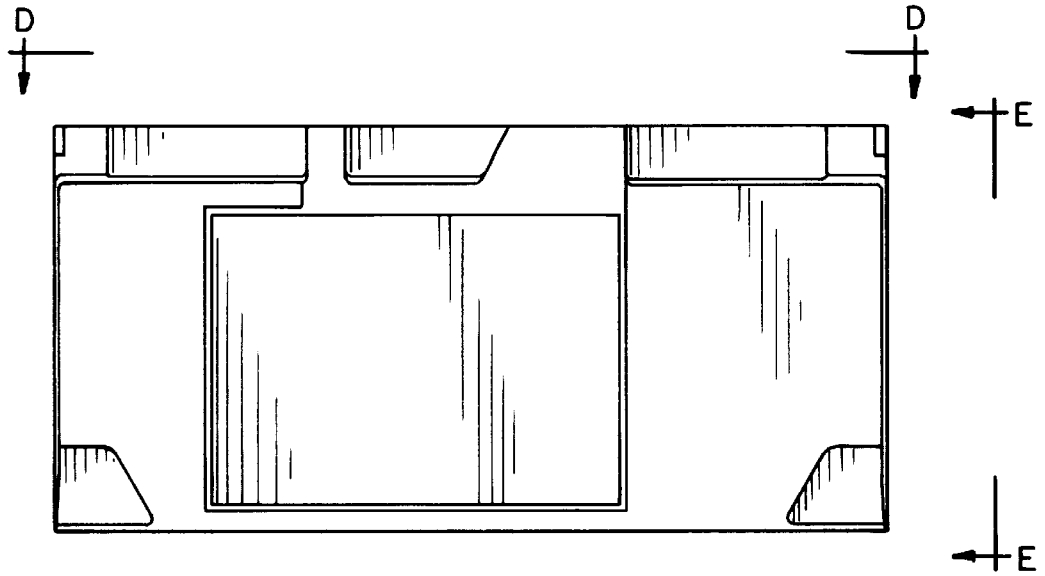
FIG. 7A is a front planar view of the lower shroud member that forms another part of the shroud assembly illustrated in FIG. 1.
Figure 7B:
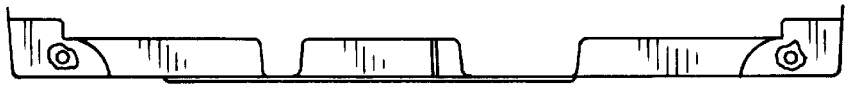
FIG. 7B is a top planar view of the lower shroud member shown in FIG. 7A taken along lines D—D therein.
Figure 7C:
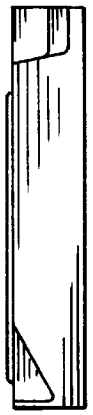
FIG. 7C is a lateral planar view of the lower shroud member shown in FIG. 7A taken along lines E—E therein.

Referring more particularly to FIG. 1, water deflection system 10 according to one embodiment of the present invention includes a front-side cover assembly 40 integrally arranged with chassis 14 at the front side thereof and comprising, in combination, an upper shroud member or liner element 42 and an associated lower shroud member or liner element 44 each removably attached to chassis 14. By way of overview, FIG. 2 represents a perspective view of chassis 14 having cover assembly 40 integrally installed therein; FIG. 3 represents a perspective view of upper shroud member 42; FIGS. 4A–C represent various planar views of upper shroud member 42; and FIGS. 7A–C represent various planar views of lower shroud member 44. FIGS. 5 and 6 represent perspective and lateral views, respectively, of a meter access cover plate arranged for removable attachment to upper shroud member 42 to cover access windows formed therein. Although only one cover assembly 40 is shown in the drawings, water deflection system 10 preferably includes another such shroud arrangement substantially identical to cover assembly 40 and disposed at a back side of chassis 14 in the same form and manner as the illustrated front-side cover assembly 40. Accordingly, for purposes of explanation herein, the discussion involving the illustrated front-side cover assembly 40 applies equally to such back-side cover assembly.

Figure 8:
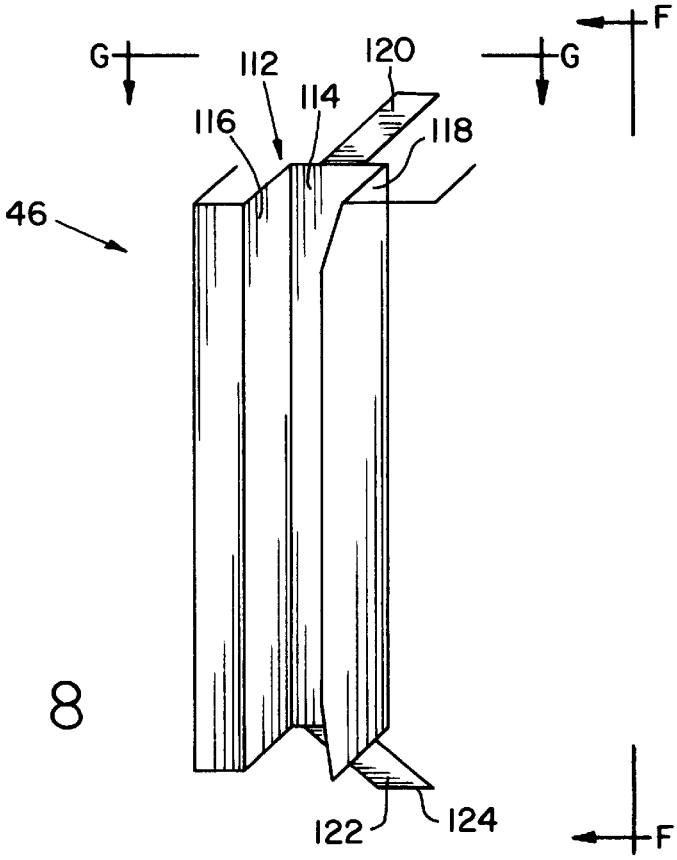
FIG. 8 is an elevational perspective view of the column channel member that forms another part of the shroud assembly illustrated in FIG. 1.
Figure 9A:
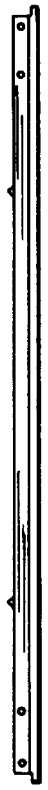
FIG. 9A is a front elevational planar view of the column channel member illustrated in FIG. 8.
Figure 9B:
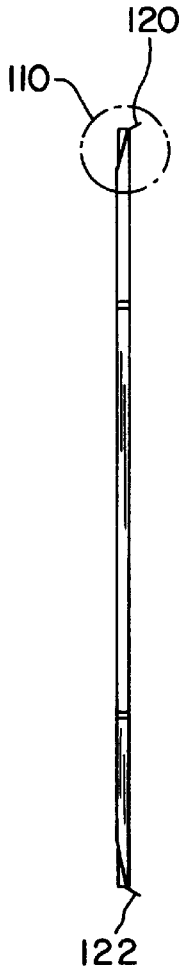
FIG. 9B is a side elevational planar view of the column channel member illustrated in FIG. 8 taken along lines F—F therein.
Figure 9C:
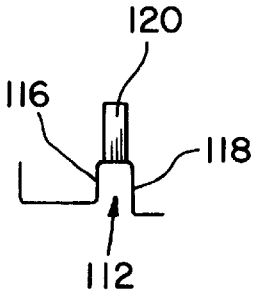
FIG. 9C is a top planar view of the column channel member illustrated in FIG. 8 taken along lines G—G therein.
Figure 9D:
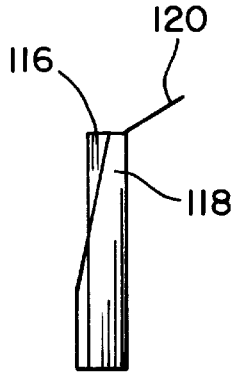
FIG. 9D is an enlarged sectional lateral view of the upper end of the column channel member illustrated in FIG. 8.
Figure 10:
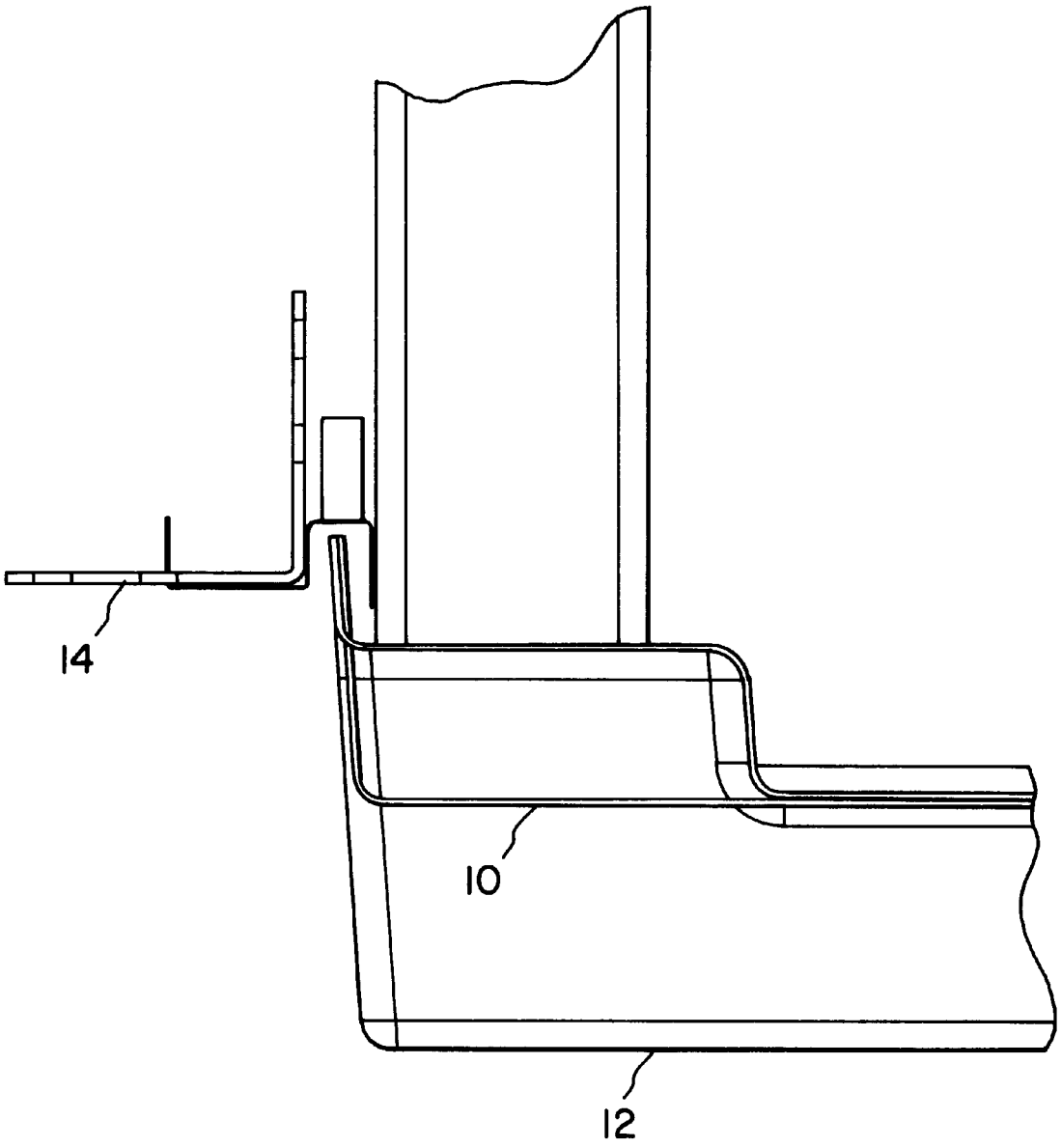
FIG. 10 is an enlarged partial upper sectional view of the integrated arrangement shown in FIG. 2 taken generally along lines H—H therein and illustrating the relative placement of the upper shroud member and lower shroud member at side edge portions thereof within a fluid channel formed within the column channel member of FIG. 8.

In accordance with another embodiment of the present invention, water deflection system 10 further includes a channel assembly 45 comprising a representative pair of elongate column channel members 46 and 48 each removably attached to column corner posts 50 and 52, respectively, of chassis 14. By way of overview, FIG. 8 represents a perspective view of one illustrative elongate column channel member 46, while FIGS. 9A–D represent various views of elongate column channel member 46. FIG. 10 represents a cross-sectional planar view taken along lines H—H of FIG. 2 showing the manner of integrating cover assembly 40 with channel assembly 45, namely, how the illustrated upper and lower shroud members 42 and 44 are registered at respective side edge portions thereof within respective longitudinal channels formed in column channel members 46 and 48.

Referring now to FIGS. 1 and 2 in conjunction with FIGS. 3–7, the illustrated upper shroud member 42 and lower shroud member 44 each defines a protective cover that acts as a second "skin" to prevent water which penetrates past the metal enclosure from entering the lower chassis section 26. In accordance with one aspect of the present invention, shroud members 42 and 44 are suitably formed and arranged such that in their as-installed configuration depicted by FIG. 2, lower shroud member 44 will be arranged in subjacent, partially overlapped relationship relative to upper shroud member 42, wherein upper shroud member 42 (at its lower edge portion 54) overlaps at least in part with lower shroud member 44 (at its upper edge portion 56). This relative orientation between shroud members 42 and 44 produces a shingle-type arrangement with a labyrinth-like "seam" between shroud members 42 and 44 that acts to prevent any part of the water flowing from upper shroud member 42 to lower shroud member 44 from migrating between the shroud arrangement. It is apparent from such an overlapping configuration that water would have to travel against gravity to be able to maneuver behind cover assembly 40 at this interface between upper shroud member 42 and lower shroud member 44. This shingle-type arrangement distinguishes favorably over edge-abutting-type seams in which small gaps exist or can develop between the cover pieces, thereby providing an access space for water to enter through. Preferably, this overlapping occurs along the entire upper edge portion 56 of lower shroud member 44 and the entire lower edge portion 54 of upper shroud member 42 to create a fully waterproof seam therebetween. More particularly, in order to create a tight, overlapping seam between upper shroud member 42 and lower shroud member 44, the contouring of lower edge portion 54 of upper shroud member 42 and the contouring of upper edge portion 56 of lower shroud member 44 are made to substantially match one another along the extent of their overlap in order to produce a surface-abutting contact engaging relationship between upper edge portion 56 and lower edge portion 54 along their overlapping sections. The upper shroud member 42 and lower shroud member 44 are preferably made using a vacuum-forming plastics technology, although any suitable material or manufacturing process could be used to produce a water-impermeable structure.

Furthermore, shroud members 42 and 44 are also suitably formed and arranged such that their integral combination results in the formation of an outward facing surface for cover assembly 40 that substantially covers the front side of chassis lower section 26, except for an arrangement of access windows formed in upper shroud member 42 that are provided with meter access cover plates and for certain spaces reserved for placement of the fuel dispensing nozzle assembly.

Referring more particularly to FIGS. 1 and 2 for details on the installation of cover assembly 40, lower shroud member 44 is provided with recessed areas 58 and 60 formed as shown at respective bottom corner locations of lower shroud member 44 and configured to accommodate the placement of a stud pin therein. In particular, each of the recessed areas 58 and 60 has a respective stud-receiving hole 62 and 64 designed to receive a corresponding positioning stud integrally provided in a bracket support member 66 forming a part of chassis base 28 and preferably extending between corner posts 50 and 52. During installation, lower shroud member 44 is placed in registered alignment with chassis 14 by positioning it in overlying engagement with chassis base 28 using the locating studs to guide lower shroud member 44 into its proper installation position. This one-to-one guiding correspondence between a stud-receiving hole and a locating stud is indicated by representative locating line 68 for stud-receiving hole 62. This form of positioning for lower shroud member 44 should not be considered in limitation of the present invention but instead is simply representative of any means by which lower shroud member 44 may be removably attached to chassis 14.

Upper shroud member 42 is integrally configured with chassis 14 using a stud-type attachment mechanism illustratively depicted by representative locating line 70, which shows a correspondence between a stud-receiving hole in upper shroud member 42 and a locating stud provided in cross-member support 72 of chassis 14 that extends between corner posts 50 and 52. The installation of upper shroud member 42 is facilitated by an arrangement of bracket pieces 74 depending downwardly from cross-member support 72. Each bracket piece 74 is provided with an extending lip flange 76 having a locating slot defined between the main bracket section and a stop support disposed at the end of the extending lip. As shown in FIG. 2, the lower edge portion 54 of upper shroud member 42 is placed into support-type registered seating engagement within the locating slots associated with the arrangement of bracket pieces 74. This placement of upper shroud member 42 relative to bracket pieces 42 is concurrent with the proper alignment of upper shroud member 42 with the locating studs provided in chassis 14. This particular form of integrating upper shroud member 42 into chassis 14 should not be considered in limitation of the present invention but instead is simply representative of any means by which upper shroud member 42 may be removably attached to chassis 14. The installation of upper shroud member 42 and lower shroud member 44 would of course take place with a view towards ensuring that the proper shingle-type overlapping orientation was implemented, namely, that lower shroud member 44 (at its upper edge portion 56) would be positioned behind and above upper shroud member 42 (at its lower edge portion 54).

Referring now to FIG. 3, there is shown an elevated perspective view of upper shroud member 42 having an upper section 80 and a lower section 82. FIG. 4A shows a front planar view of upper shroud member 42, while FIGS. 4B and 4C respectively illustrate a top planar view and a lateral cross-sectional planar view of upper shroud member 42 taken respectively along lines A—A and B—B of FIG. 4A. The illustrated lower section 82 of upper shroud member 42 includes an arrangement of projections or protruding sections 84 and 86 each extending outwardly from a main surface 88 of lower section 82 to respectively define inner-facing spatial areas or cavities that accommodate the geometry of any structure that may extend into such cavities once upper shroud member 42 is installed within chassis 14. For example, these spatial cavities may receive certain irregular-shaped pieces of the chassis frame and/or portions of fuel dispenser components housed within chassis 14. Accordingly, the illustrated forms, shapes, and contours for projections 84 and 86 are disclosed for illustrative purposes only and should not be considered in limitation of the present invention. More generally, the indicated form of upper shroud member 42 should not be considered in limitation of the present invention but instead is simply representative of one illustrative configuration thereof.

The illustrated upper section 80 of upper shroud member 42 includes an arrangement of access structures 88 and 90 each having a respective aperture or access window 92 and 94 formed therethrough to enable access by a service person to the area behind cover assembly 40 without having to remove any of the shroud assembly. This access would typically be needed to conduct a service task or perform some other type of maintenance operation relative to the fuel dispenser components. Accordingly, the illustrated access portions 88 and 90 are preferably arranged directly in front of the components to be serviced. There is similarly provided another access structure 96 disposed at one end of upper section 80 enabling access to the interior space of chassis 14 proximate column corner post 52. Formation 98 is required to provide clearance around the nozzle boot. Shroud 80 passes under the nozzle boot and projects inwards of the dispenser far enough, to catch any liquids that enter the hydraulics cabinet and thereby direct liquids outward from the interior of the cabinet. As shown, there is further provided an arrangement of through-areas 96, 98, and 100 having the illustrated shapes to define receptacle spaces or holding areas for accommodating the nozzle/boot apparatus of the fuel dispensing equipment.

Referring to FIG. 5, there is shown a perspective view of an access cover plate 102 that is formed and arranged to be removably attached to access structure 88, for example, to thereby define a removable covering for aperture 92. The illustrated access cover plate 102 is preferably provided with inner-projecting tab sections 104 that fit in a spring-type clasping manner over respective portions of the raised, flange-type perimeter structure 106 circumscribing aperture 92. FIG. 6 represents a lateral view of access cover plate 102 taken along lines C—C of FIG. 5.

Referring to FIGS. 7A—C, there is shown in FIG. 7A a front planar view of lower shroud member 44, while FIGS. 7B and 7C respectively illustrate a top planar view and a lateral planar view taken respectively along lines D—D and E—E of FIG. 7A. Shroud member 44 is formed in a manner to surround the support members of the cabinet and components therein, so as to separate these parts from the exterior doors and provide a protective layer which directs liquids outwards and away from the interior of the cabinet and not interfere with the fit, form, or function of the dispenser cabinet or components held within.

Referring now to FIG. 8, there is shown a perspective view of elongate column channel member 46 that forms part of channel assembly 45 (FIG. 1) provided in accordance with another embodiment of the present invention. As described previously, channel assembly 45 includes a respective elongate column channel member 46 removably attached to each respective corresponding one of the corner posts 50 of chassis 14. Referring briefly to FIGS. 9A–D in conjunction with FIG. 8, FIG. 9A depicts a front elevational planar view of column channel member 46 illustrated in FIG. 8; FIG. 9B is a side elevational planar view of column channel member 46 taken along lines F—F of FIG. 8; FIG. 9C is a top planar view of column channel member 46 taken along lines G—G of FIG. 8; and FIG. 9D is an enlarged sectional lateral view of the upper end of column channel member 46 represented by reference circle 110 of FIG. 9B.

The illustrated elongate column channel member 46 of FIG. 8 includes a channel formation represented generally at 112 having a base surface 114 and a pair-of spaced-apart facing side surfaces 116 and 118 extending from the edge of base surface 114. Channel formation 112 defines a fluid passageway and also provides a spatial area within which upper shroud member 42 and lower shroud member 44 are disposed at respective side edge portions thereof to facilitate their secured positioning within chassis 14 (see FIG. 10 discussion below). In accordance with another aspect of the present invention, there is disposed at an upper end of elongate column channel member 46 an ascending lip or ramp-like structure 120 that extends rearwardly and upwardly from an upper terminal edge of channel formation 112 such that ascending lip 120 slopes toward channel formation 112, enabling any water thereon to be urged to flow under the influence of gravity into channel formation 112. Furthermore, there is disposed at a lower end of elongate column channel member 46 a descending lip or ramp-like structure 122 that extends rearwardly and downwardly from a lower terminal edge of channel formation 112 such that descending lip 122 slopes away from channel formation 112, enabling any water flowing onto it from channel formation 112 to be deposited away from channel formation 112. In accordance with another aspect of the present invention, descending lip 122 is suitably arranged such that at least its terminal edge 124 lies outside the cabinet environment, thereby providing a capability to have water that is routed from the interior space of chassis 14 and placed into channel formation 112 via ascending lip 120 or by other such passage into channel formation 112 to be deposited at a location exterior to cabinet 12 where it cannot find its way into sump facility 34. The beveled edges are required to provide clearance between the hydraulic cabinet door and surface 118. The reason for the difference in widths of surfaces 116 and 118 is to allow the part in FIG. 9 to create a labyrinth style path for water to sufficiently lose enough kinetic energy and allow gravity to direct the water downwards. Additionally, this arrangement is required to fit within the confines of the chassis design.

Referring to FIG. 10, there is shown an enlarged partial upper sectional view of the integrated arrangement shown in FIG. 2 taken generally along lines H—H therein and illustrating the relative placement of upper shroud member 42 and lower shroud member 44 at respective side edge portions thereof within channel formation 112 of the illustrated elongate column channel member 46. Accordingly, during installation, each one of the elongate column channel members 46 of channel assembly 45 is first integrally arranged with its respective column corner post 50 before each pair of associated upper shroud member 42 and lower shroud member 44 of cover assembly 40 is integrally configured within chassis 14. Furthermore, as shown, the illustrated elongate column channel member 46 is provided with a representative locating tab or flange portion 124 that fits through a corresponding hole in column corner post 50 to facilitate its removable attachment to chassis 14. This form of attachment should not be considered in limitation of the present invention but instead is simply representative of any means by which elongate column channel member 46 can be removably attached to chassis 14.

Figure 11:
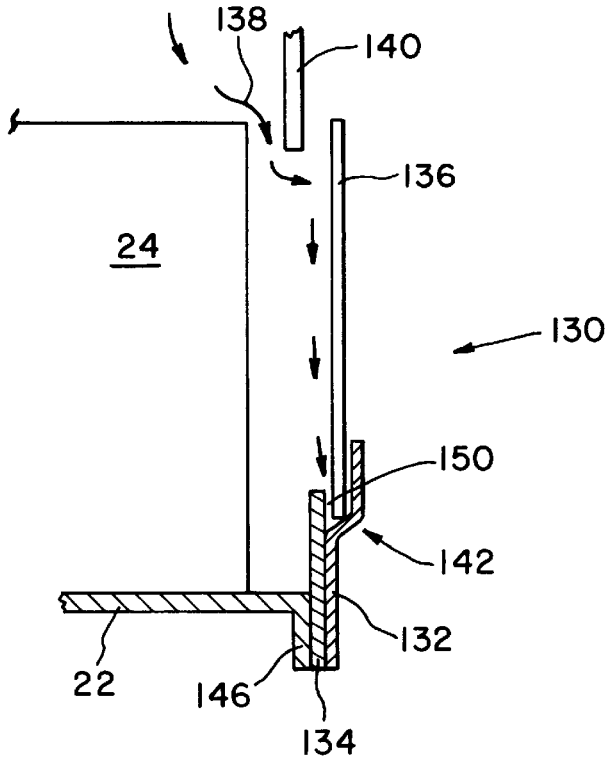
FIG. 11 is a side elevational planar schematic view illustrating the integral arrangement of parts that compose the column area fluid collection and diversion assembly provided in accordance with another embodiment of the present invention, which operates to collect and reroute water that enters the fuel dispenser cabinet chassis from above the electronics enclosure area.
Figure 12:
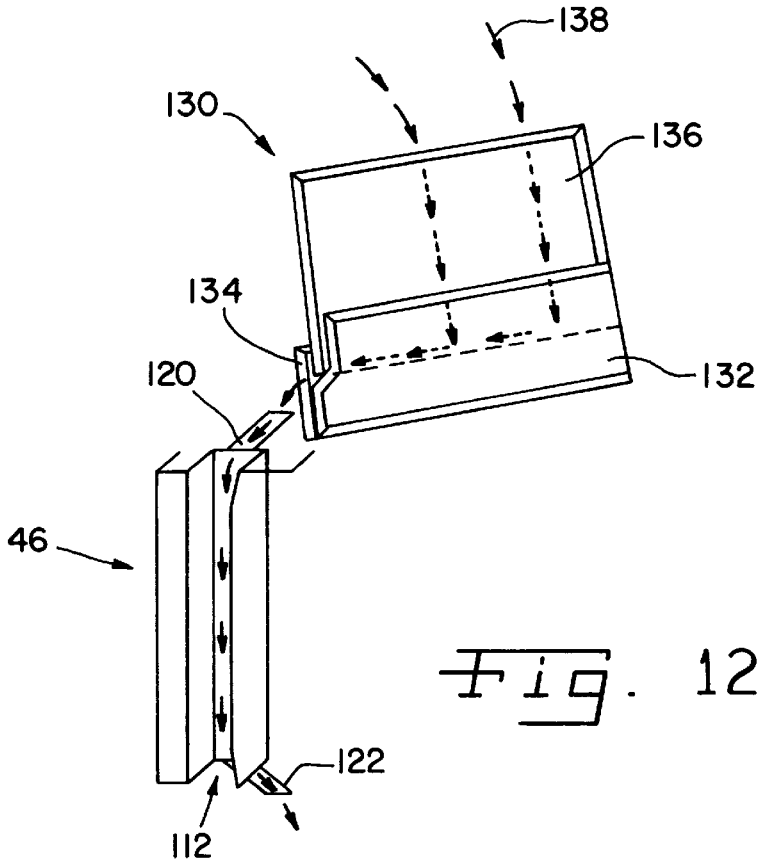
FIG. 12 is a perspective view illustrating the as-installed positional relationship between the fluid collection and diversion assembly of FIG. 11 and the elongate column channel member of FIG. 8 to show the cooperative manner by which diverted fluid is communicated into the channel structure to enable its transfer to the exterior of the fuel dispenser cabinet, according to another aspect of the present invention.
Figure 13:
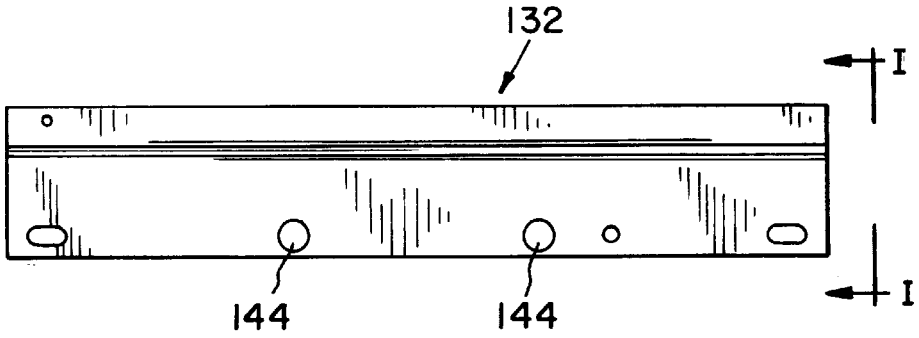
FIG. 13 is a front planar schematic view of the end channel member that forms one part of the column area fluid diversion assembly shown in FIG. 11.
Figure 14:
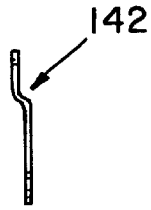
FIG. 14 is a side elevational planar schematic view of the end channel member illustrated in FIG. 13 taken along lines I—I therein.
Figure 15:
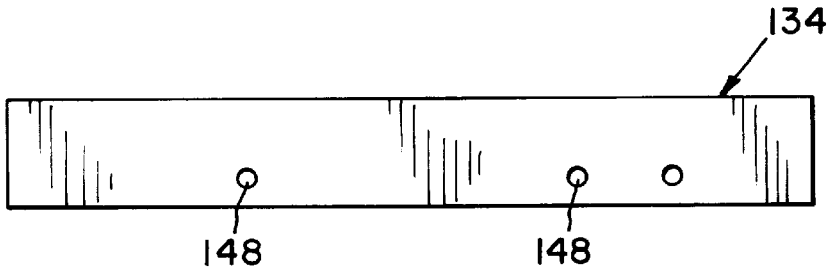
FIG. 15 is a front planar schematic view of the seal plate that forms another part of the column area fluid diversion assembly shown in FIG. 11.
Figure 16:
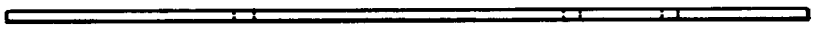
FIG. 16 is a top elevational planar schematic view of the seal plate illustrated in FIG. 15.
Figure 17:
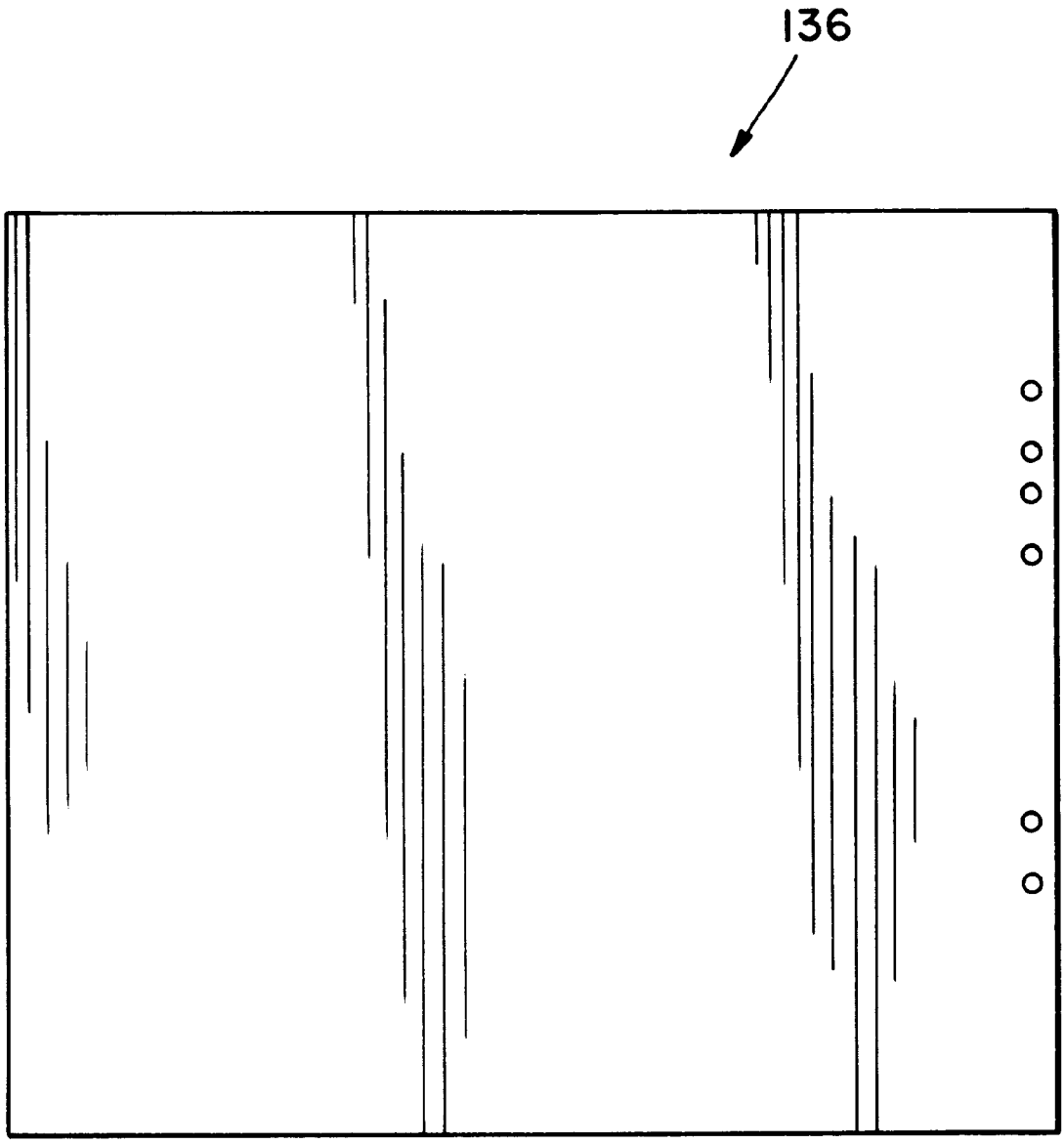
FIG. 17 is a front planar schematic view of the column splash shield that forms another part of the column area fluid diversion assembly shown in FIG. 11.

Referring now to FIGS. 11–17, and in accordance with another embodiment of the present invention, there is first shown in FIG. 11 a side elevational planar view of a fluid collection and diversion assembly ("fluid diversion assembly") 130, while there is shown in FIG. 12 a perspective view illustrating the as-installed positional relationship between fluid diversion assembly 130 and elongate column channel member 46 of FIG. 8 to illustrate the cooperative manner by which diverted fluid is communicated into channel formation 112 to enable its transfer to the exterior of the fuel dispenser cabinet 12. The illustrated fluid diversion assembly 130 of FIG. 11 comprises, in combination, an end channel member 132, a seal plate 134, and a column splash shield 136. By way of overview, FIG. 13 is a front planar schematic view of end channel member 132; FIG. 14 is a side elevational planar schematic view of end channel member 132 taken along lines I—I in FIG. 13; FIG. 15 is a front planar schematic view of seal plate 134; FIG. 16 is a top elevational planar schematic view of seal plate 134; and FIG. 17 is a front planar schematic view of column splash shield 136.

Referring specifically to fluid diversion assembly 130 in FIG. 11, this illustrated arrangement of parts 132, 134, and 136 functions generally to intercept any water that enters chassis head portion 20 and travels (as representative fluid stream 138) past the seam defined between the rightmost edge of electronics equipment 24 and inner column skin 140, which is illustratively provided as shown in FIG. 1 in the end column area at the right-hand side of chassis 14. FIG. 11 depicts the fluid diversion assembly 130 that would be integrally configured within chassis 14 at its right-hand side, although it is preferable to have an identical such fluid diversion assembly 130 placed at the opposing end column area at the left-hand side of chassis 14.

Referring to FIG. 11 in conjunction with FIGS. 13 and 14, the illustrated end channel member 132 defines a crossmember-type wall formation or panel structure having a shoulder portion shown illustratively at 142 (see FIG. 14) that defines a generally "S"-shaped cross-sectional profile for end channel member 132. This shoulder portion 142 preferably extends along the entire longitudinal dimension of end channel member 132. Referring to FIGS. 15 and 16, the illustrated seal plate 134 defines a generally planar panel structure having a longitudinal dimension preferably identical to that of end channel member 132. Seal plate 134 preferably has the indicated rectangular shape, although this particular dimensional form should not be considered in limitation of the present invention but instead should serve as one illustrative example thereof. Referring to FIG. 17, the illustrated splash shield 136 defines a generally planar panel structure having a longitudinal dimension preferably identical to that of end channel member 132. The particular shape of splash shield 136 indicated in FIG. 17 should not be considered in limitation of the present invention but instead should serve as one illustrative example thereof.

Referring in more particular detail to FIGS. 11 and 12, FIG. 11 illustratively depicts the integral combination of end channel member 132, seal plate 134, and column splash shield 136 as configured after installation at the right-hand side of chassis 14, along with their relative positioning vis-a-vis barrier plate 22, electronics equipment 24, and inner column skin 140. As shown, seal plate 134 is disposed in adjacent surface-abutting facing engagement with end channel member 132 along the entirety of their respective longitudinal dimensions over which end channel member 132 and seal plate 134 are disposed in facing opposition to one another. This coupled arrangement of end channel member 132 and seal plate 134 is attached to a downward-extending lip-type flange portion 146 of barrier plate 22 to collectively form a seal that inhibits the migration of upward-flowing vapors (e.g., from chassis lower section 26) past barrier plate 22 and into the chassis upper section 18 containing electronics equipment 24. Gasket seals (not shown) may be provided in combination with this sealing arrangement to facilitate a more complete seal. End channel member 132 and seal plate 134 are preferably provided in removable attachment to chassis 14 (i.e., barrier plate 22) using respective representative stud holes 144 (see FIG. 13) and 148 (see FIG. 15) that are aligned with one another during installation and receive a common stud or screw element. Furthermore, during installation, column splash shield 136 is disposed at a lower end portion thereof in registered seating engagement with end channel member 132 at the upper surface of its shoulder portion 142. As shown, this integral placement of splash shield 136 relative to end channel member 132 produces a spaced-apart facing orientation between splash shield 136 and end channel member 132. In more broader terms, these structural elements of fluid diversion assembly 130 are configured in the indicated manner such that the arrangement of splash shield 136 (i.e., at its lower end), seal plate 134 (i.e., at its upper end), and end channel member 132 (i.e., at a part of its shoulder portion 142) cooperatively define a transverse fluid passageway 150 that extends along the longitudinal dimension of this integral arrangement.

In operation, with continuing reference to FIGS. 11 and 12, water 138 that strikes the inner-facing surface of column splash shield 136 is drawn downwards under the influence of gravity into transverse fluid passageway 150. Referring particularly to FIG. 12, and in accordance with another aspect of the present invention, fluid diversion assembly 130 is sufficiently arranged relative to both of the elongate column channel members 46 installed at the respective pair of column corner posts 52 located at the right-hand side of chassis 14 such that transverse fluid passageway 150 at respective ends thereof is provided in fluid communication with the respective ascending lips 120 of both elongate column channel members 46. Accordingly, water 138 that is intercepted by column splash shield 136, makes its way down into fluid passageway 150, and traverses the remaining length of fluid passageway 150 in either direction (i.e., towards the front or back side of chassis 14) can be transferred to ascending lip 120 of an associated elongate column channel member 46, where it subsequently flows along the vertically-directed channel formation 112 before traversing descending lip 122 at the bottom end of channel formation 112 and becoming deposited outside the environment of cabinet 12. As mentioned previously, descending lip 122 is sufficiently arranged such that water flowing along is placed outside the confines of cabinet 12 and particularly sump facility 34. It is therefore apparent that water present within compartment space 18 can be captured by fluid diversion assembly 130 and routed to a desired location outside the cabinet boundaries where it no longer represents a risk insofar as becoming an unwanted addition to sump facility 34.

Water deflection system disclosed herein may be provided in various alternative forms. For example, although cover assembly 40 is provided in a two-piece shroud arrangement, the present invention is not so limited but may be configured as a one-piece structure or as a multi-piece arrangement (i.e., more than two shroud members) in which adjacent shroud pieces have the indicated shingle-type overlapping feature. Additionally, the indicated arrangement of pieces for fluid diversion assembly 130 should not be considered in limitation of the present invention but instead should be understood as encompassing any means by which water penetrating the chassis upper section can be intercepted and drawn into a fluid passageway for subsequent transfer to a channel means (e.g., elongate column channel member 46) preferably provided at the column corner posts.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluid deflection system for use in a fuel dispenser cabinet, said fuel dispenser cabinet including a chassis having an interior space, said chassis further having a pair of opposing spaced-apart side areas and a pair of opposing spaced-apart end areas extending between said pair of opposing side areas, said fluid deflection system comprising:

at least one cover assembly each adapted to be integrally arranged with said chassis at a respective one of said pair of chassis side areas;

each respective one of said at least one cover assembly respectively comprising:

an upper shroud member adapted to be removably attached to said chassis and extending between said pair of chassis end areas, said upper shroud member having an upper edge portion and a lower edge portion, and a lower shroud member adapted to be removably attached to said chassis and extending between said pair of chassis end areas, said lower shroud member having an upper edge portion and a lower edge portion, said lower shroud member being arranged in subjacent relationship relative to said upper shroud member, wherein said upper shroud member at the lower edge portion thereof overlaps at least in part with said lower shroud member at the upper edge portion thereof forming a shingle type arrangement.

2. The fluid deflection system as recited in claim 1, wherein each respective one of said at least one cover assembly further comprises:

at least one elongate column channel member each removably attached to a respective column corner post of said chassis;

each respective one of said at least one elongate column channel member respectively including a channel portion extending substantially in a vertical direction, said channel portion being arranged to receive said upper shroud member associated with said respective one cover assembly at a respective shroud side edge portion thereof and to receive said lower shroud member associated with said respective one cover assembly at a respective shroud side edge portion thereof.

3. The fluid deflection system as recited in claim 1, wherein the respective upper shroud member of each respective one of said at least one cover assembly further comprises:

at least one aperture formed therethrough to define an accessway into the interior space of said chassis.

4. The fluid deflection system as recited in claim 3, wherein each respective one of said at least one cover assembly further comprises:

a respective cover plate for each respective one of said at least one aperture formed through said upper shroud member of said respective one cover assembly;

wherein said respective cover plate for each respective one of said at least one aperture being removably attached to said upper shroud member and being arranged to cover said respective one aperture.

5. The fluid deflection system as recited in claim 1, wherein each respective one of said at least one cover assembly being disposed at a lower end of said chassis adjacent a base thereof.

6. The fluid deflection system as recited in claim 5, wherein the lower shroud member of each respective one of said at least one cover assembly being removably attached to said chassis at the base thereof.

7. The fluid deflection system as recited in claim 2, further comprises:

at least one fluid diversion assembly each integrally arranged with said chassis at a respective one of said pair of chassis end areas;

each respective one of said at least one fluid diversion assembly respectively comprising:

a transverse wall structure removably attached to said chassis and extending at least in part between said pair of chassis side areas, said transverse wall structure including a shoulder portion extending along the longitudinal dimension thereof, a splash shield removably attached to said chassis and having a lower edge portion, said splash shield being disposed at the lower edge portion thereof in registered seating engagement with said transverse wall structure at the shoulder portion thereof, and a seal plate disposed in adjacent surface-abutting engagement with said transverse wall structure and being arranged in spaced-apart relationship relative to said splash shield, wherein the arrangement of said splash shield at a lower end thereof, said seal plate at an upper end thereof, and said transverse wall structure at a part of the shoulder portion thereof cooperatively defining a transverse fluid passageway extending along the longitudinal dimension of said transverse wall structure, wherein said transverse fluid passageway being sufficiently arranged to enable fluid communication with the respective channel portion of a respective elongate column channel member respectively associated with at least one of said at least one cover assembly.

8. The fluid deflection system as recited in claim 7, wherein each respective one of said at least one fluid diversion assembly being disposed at an upper end of said chassis adjacent a device compartment which operatively houses fuel dispenser components.

9. The fluid deflection system as recited in claim 8, wherein the respective seal plate of each respective one of said at least one fluid diversion assembly being arranged in sealing engagement to a respective portion of a barrier plate which defines a lower end of said device compartment.

10. The fluid deflection system as recited in claim 3, wherein each respective one of said at least one elongate column channel member for each respective one of said at least one cover assembly further comprises:

an ascending lip structure projecting from an upper terminal edge of the channel portion of said respective one elongate column channel member; and a descending lip structure projecting from a lower terminal edge of the channel portion of said respective one elongate column channel member.

11. The fluid deflection system as recited in claim 10, wherein the ascending lip structure of each respective one of said at least one elongate column channel member for each respective one of said at least one cover assembly being provided in a manner sufficient to enable fluid communication with the transverse fluid passageway of a respective one of said at least one fluid diversion assembly.

12. The fluid deflection system as recited in claim 11, wherein the descending lip structure of each respective one of said at least one elongate column channel member for each respective one of said at least one cover assembly further including a respective terminal edge portion lying outside the interior space of said chassis.

13. A fluid detection system for use in a fuel dispenser cabinet, said fuel dispenser cabinet including a chassis having an interior space, said chassis further having a pair of opposing spaced-apart side areas and a pair of opposing spaced-apart end areas extending between said pair of opposing side areas, said fluid deflection system comprising:

a pair of cover assemblies each adapted to be integrally arranged with said chassis at a respective one of said pair of chassis side areas; and a pair of fluid diversion assemblies each adapted to be integrally arranged with said chassis at a respective one of said pair of chassis end areas;

each respective one of said pair of cover assemblies respectively comprising:

an upper shroud member adapted to be removably attached to said chassis and extending between said pair of chassis end areas, said upper shroud member having an upper edge portion and a lower edge portion, a lower shroud member removably attached to said chassis and extending between said pair of chassis end areas, said lower shroud member having an upper edge portion and a lower edge portion, and a pair of elongate column channel members each adapted to be removably attached to a respective column corner post of said chassis, wherein said lower shroud member being arranged in subjacent relationship relative to said upper shroud member, wherein said upper shroud member at the lower edge portion thereof overlaps at least in part with said lower shroud member at the upper edge portion thereof, wherein each respective one of said pair of elongate column channel members respectively including a channel portion extending substantially in a vertical direction, said channel portion being arranged to receive said upper shroud member at a respective shroud side edge portion thereof and to receive said lower shroud member at a respective shroud side edge portion thereof;

each respective one of said pair of fluid diversion assemblies respectively comprising:

a transverse wall structure adapted to be removably attached to said chassis, said transverse wall structure extending at least in part between said pair of chassis side areas and including a shoulder portion extending along the longitudinal dimension thereof, a splash shield adapted to be removably attached to said chassis and having a lower edge portion, said splash shield being disposed at the lower edge portion thereof in registered seating engagement with said transverse wall structure at the shoulder portion thereof, and a seal plate disposed in adjacent surface-abutting engagement with said transverse wall structure, said seal plate being arranged in spaced-apart relationship relative to said splash shield and being further arranged in at least partial opposition to said splash shield, wherein the arrangement of said splash shield at a lower end thereof, said seal plate at an upper end thereof, and said transverse wall structure at a part of the shoulder portion thereof cooperatively defining a transverse fluid passageway extending along the longitudinal dimension of said transverse wall structure, wherein said transverse fluid passageway being sufficiently arranged to enable fluid communication with the respective channel portion of a respective one of said respective pair of elongate column channel members from each respective one of said pair of cover assemblies.

14. The fluid deflection system as recited in claim 13, wherein the respective upper shroud member of each respective one of said pair of cover assemblies further comprises:

at least one aperture formed therethrough to define an accessway into the interior space of said chassis.

15. The fluid deflection system as recited in claim 14, wherein each respective one of said pair of cover assemblies further comprises:

a respective cover plate for each respective one of said at least one aperture formed through said upper shroud member of said respective one cover assembly;

wherein said respective cover plate for each respective one of said at least one aperture being removably attached to said upper shroud member and being arranged to cover said respective one aperture.

16. The fluid deflection system as recited in claim 13, wherein each respective one of said pair of cover assemblies being disposed at a lower end of said chassis adjacent a base thereof.

17. The fluid deflection system as recited in claim 16, wherein the lower shroud member of each respective one of said pair of cover assemblies being removably attached to said chassis at the base thereof.

18. The fluid deflection system as recited in claim 13, wherein each respective one of said pair of fluid diversion assemblies being disposed at an upper end of said chassis adjacent a device compartment which operatively houses fuel dispenser components.

19. The fluid deflection system as recited in claim 18, wherein the respective seal plate of each respective one of said pair of fluid diversion assemblies being arranged in sealing engagement to a respective portion of a barrier plate which defines a lower end of said device compartment.

20. The fluid deflection system as recited in claim 13, wherein each respective one of said pair of elongate column channel members for each respective one of said pair of cover assemblies further comprises:

an ascending lip structure projecting from an upper terminal edge of the respective channel portion of said respective one elongate column channel member; and a descending lip structure projecting from a lower terminal edge of the respective channel portion of said respective one elongate column channel member.

21. The fluid deflection system as recited in claim 20, wherein the respective ascending lip structure of each respective one of said pair of elongate column channel members for each respective one of said pair of cover assemblies being provided in a manner sufficient to enable fluid communication with the transverse fluid passageway of a respective one of said pair of fluid diversion assemblies.

22. The fluid deflection system as recited in claim 21, wherein the respective descending lip structure of each respective one of said pair of elongate column channel members for each respective one of said pair of cover assemblies further including a respective terminal edge portion lying outside the interior space of said chassis.

23. A fluid deflection system for use in a fuel dispenser cabinet, said fuel dispenser cabinet including a chassis having an interior space, said chassis further having a pair of opposing spaced-apart side areas and a pair of opposing spaced-apart end areas extending between said pair of opposing side areas, said fluid deflection system comprising:

at least one cover means, adapted to be disposed at a respective one of said pair of chassis side areas, for providing a fluid barrier, at least in part, between the interior space of said chassis and an exterior of said chassis;

at least one channel means, adapted to be disposed at a respective corner post of said chassis, for defining a channel formation opening in a vertical direction and extending in a substantially horizontal longitudinal direction; and at least one fluid diversion means, adapted to be disposed at a respective one of said pair of chassis end areas, for providing a fluid passageway arranged to enable fluid communication with a respective one of said at least one channel means and for providing a contact structure extending from said fluid passageway which enables fluid in contact therewith to be drawn into said fluid passageway.

24. The fluid deflection system as recited in claim 23, wherein each respective one of said at least one cover means further comprises:

an upper shroud member removably attached to said chassis and extending between said pair of chassis end areas, said upper shroud member having an upper edge portion and a lower edge portion; and a lower shroud member removably attached to said chassis and extending between said pair of chassis end areas, said lower shroud member having an upper edge portion and a lower edge portion;

wherein said lower shroud member being arranged in subjacent relationship relative to said upper shroud member, wherein said upper shroud member at the lower edge portion thereof overlaps at least in part with said lower shroud member at the upper edge portion thereof forming a shingle type arrangement.

25. The fluid deflection system as recited in claim 24, wherein each respective one of said at least one channel means further comprises:

an elongate column channel member associated with a respective one of said at least one cover means;

wherein said elongate column channel member being removably attached to a respective column corner post of said chassis and including a channel portion extending substantially in a vertical direction;

wherein said channel portion being arranged to receive the respective upper shroud member of said respective one cover means associated therewith at a respective shroud side edge portion thereof and to receive the respective lower shroud member of said respective one cover means associated therewith at a respective shroud side edge portion thereof.

26. The fluid deflection system as recited in claim 25, wherein each respective one of said at least one fluid diversion means further comprises:

a transverse wall structure removably attached to said chassis, said transverse wall structure extending at least in part between said pair of chassis side areas and including a shoulder portion extending along the longitudinal dimension thereof, a splash shield removably attached to said chassis and having a lower edge portion, said splash shield being disposed at the lower edge portion thereof in registered seating engagement with said transverse wall structure at the shoulder portion thereof, and a seal plate disposed in adjacent surface-abutting engagement with said transverse wall structure, said seal plate being arranged in spaced-apart relationship relative to said splash shield and being further arranged in at least partial opposition to said splash shield, wherein the arrangement of said splash shield at a lower end thereof, said seal plate at an upper end thereof, and said transverse wall structure at a part of the shoulder portion thereof cooperatively defining a transverse fluid passageway extending along the longitudinal dimension of said transverse wall structure, wherein said transverse fluid passageway being sufficiently arranged to enable fluid communication with the respective channel portion of a respective elongate column channel member associated with at least a respective one of said at least one cover means.

* * * * *